US006062850A

United States Patent [19]

Ino et al.

[11] Patent Number: 6,062,850

[45] Date of Patent: May 16, 2000

[54] PAINT CURING OVEN

[75] Inventors: Masanori Ino, Sayama; Susumu Nakahara; Yoshiyuki Nakai, both of Suzuka, all of Japan; Anthony Seccareccia, Baxter, Canada; Shunji Nakamura, Suzuka, Japan

[73] Assignee: Honda Giken Kogyo Kabushiki Kaisha, Tokyo, Japan

[21] Appl. No.: 09/196,325

[22] Filed: Nov. 19, 1998

[30] Foreign Application Priority Data

Nov. 21, 1997 [JP] Japan ..... 9-321316

[51] Int. Cl.[7] ..... F27B 9/24; F27B 9/36

[52] U.S. Cl. ..... 432/143; 432/128; 34/270; 34/666

[58] Field of Search ..... 432/128, 135, 432/137, 143, 146, 147; 34/215, 216, 267, 270, 666

[56] References Cited

U.S. PATENT DOCUMENTS

| | | | |
|---|---|---|---|
| 4,493,641 | 1/1985 | Hubbert | 432/144 |
| 4,773,851 | 9/1988 | Mueller | 432/144 |
| 5,172,849 | 12/1992 | Barten et al. | 432/128 |
| 5,588,830 | 12/1996 | Josefsson et al. | 432/143 |
| 5,823,767 | 10/1998 | Watanabe et al. | 432/72 |
| 5,906,485 | 5/1999 | Groff et al. | 432/146 |

FOREIGN PATENT DOCUMENTS 2-90970 3/1990 Japan .

*Primary Examiner*—Teresa Walberg
*Assistant Examiner*—Gregory A. Wilson
*Attorney, Agent, or Firm*—Arent Fox Kintner Plotkin & Kahn PLLC

[57] ABSTRACT

A drying oven for curing paint applied to a vehicle comprising a housing, radiant heat panel located on the side walls of the housing, a conveyor for carrying a vehicle through the housing and a convection heater unit positioned at a height below the conveyor such that heat from the convection heater is directed onto the under floor of the vehicle passing through the housing on the conveyor. In a first embodiment, the convection heater unit includes a feed pipe positioned below the conveyor and a plurality of nozzles extending from the feed pipe for directing hot air onto the under floor of the vehicle. In a second embodiment, a plurality of heat ducts are located below and to the side of the conveyor, each heat duct having an opening directed at the under floor of the vehicle on the conveyor for directing hot air onto the under floor of the vehicle.

14 Claims, 12 Drawing Sheets

PAINT CURING OVEN

BACKGROUND OF THE INVENTION

1. Field of the Invention

The present invention is directed to a drying oven for curing paint applied to a vehicle during the manufacturing of the vehicle.

2. Description of the Prior Art

Curing ovens for curing vehicle body paint are known. For example, in Japanese Laid-Open Publication No. 2-90970, a curing oven has right and left side walls with radiant panels positioned on the side walls. Heat is generated from the radiant panels to cure the painted vehicle, particularly the side and roof of the vehicle body. Further, the oven has left and right partitions with ducts positioned below the partitions that blow hot air to cure the vehicle, particularly the floor of the vehicle, as it sits on a conveyor.

In this prior art curing oven, the under floor of the body is heated only by convection from the side ducts. Because the hot air velocity is very slow in the center of the oven, the heating capacity is at a minimum in the center of the oven. However, the thickness of the steel of the floor of the vehicle is heavier than the side panels and the roof of the vehicle, requiring more time to raise the temperature thereof. It is thus difficult to bake and thereby cure the center of the under floor of the vehicle and a longer oven time is required to bake this area. This increases the overall length of the oven, increases the costs of the equipment, and also increases the energy consumption.

SUMMARY OF THE INVENTION

It is the primary object of the present invention to shorten the length of the oven and thereby reduce the equipment cost and energy cost. In order to achieve the above object, the present invention cures the left and right side panels by radiation, and cures the under floor by convection, wherein the floor of the oven has a number of jet cone nozzles directed at the under floor of the vehicle body or alternatively a plurality of heat ducts directed at the under floor of the vehicle body.

The dead space below the conveyor in the oven is utilized to locate the nozzles so as to ensure air flow over the entire floor area of the vehicle. Alternatively, the heat ducts are located below and to the side of the conveyor. The time required for curing is shortened by the efficient baking of the floor of the vehicle, thereby reducing the overall curing time of the vehicle. Furthermore, the heating capacity of the under floor of the vehicle is enhanced by the increase in coefficient of heat transfer due to the heat jet convection method.

The nozzles of the present invention are small pipes inclined at a predetermined angle to the vertical axis. Because the nozzles are inclined, if particles, loose parts, dirt or any other object should fall towards the nozzles, it will not enter into the nozzles. As a result, nozzle maintenance can be minimized and routine maintenance can be scheduled at long intervals thereby improving operation efficiency of the oven.

The present invention results in the floor being baked to the right temperature thereby eliminating the need to apply wax as a rust inhibitor. Benefits are achieved in equipment and material costs, reduction in manpower and elimination of the wax which discharges hydrocarbons.

DETAILED DESCRIPTION OF THE PREFERRED EMBODIMENT

Figure 1:
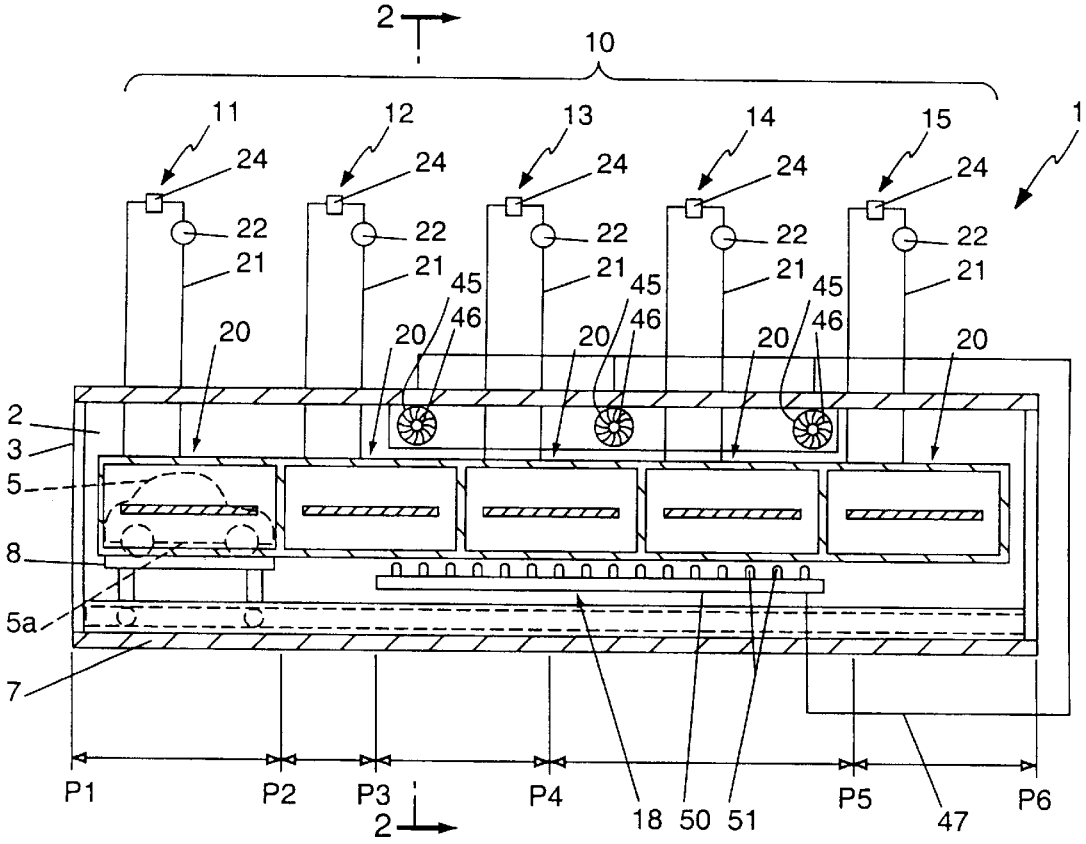
FIG. 1 is a sectional view of a vehicle drying oven of a first embodiment of the present invention.

FIG. 1 is a sectional view of an oven of a first embodiment of the present invention. The oven 1 has a curing space 2 comprising a main oven unit or housing 3, where the vehicle body 5 is transported on a conveyor 8 installed on the floor 7. The vehicle body 5 is cured by radiant, curing panels positioned in curing sections 11–15, and a convection section 18 located beneath the under floor 5*a* of the vehicle body 5.

The first preheat zone of the oven 1, which is located between points P1 and P2, bakes the vehicle body 5 using a first radiant heat panel section 11. The second oven preheat zone located between points P2 and P3 bakes the vehicle body 5 with a second radiant panel curing section 12. The heat-up zone between points P3 and P4 bakes the vehicle body with second and third radiant panel sections 12 and 13, and convection section 18. The keep zone between points P4 and P5, bakes the vehicle body with third and fourth radiant panel sections 13 and 14 and convection section 18. In the zone between points P5 and P6, the vehicle body 5 is baked with the fifth radiant curing panel section 15.

The first to fifth radiant panel curing sections 11–15, are all of the same structure. Only the first radiant panel curing section 11 will be explained in detail, but the second through fifth radiant panel curing sections 12–15 have the same structure. The first radiant panel curing section 11 comprises a radiant zone 20 that generates radiation, a circulation duct 21, a circulation fan 22, and heater 24 located midway in the circulation duct 21.

In heating the first to fifth radiant panel curing sections 11–15, the temperature of the body in the first radiant panel curing section should not exceed the temperature of 120° C., and in the second to fifth radiant panel curing sections, the temperature should not exceed 170° C.

Figure 2:
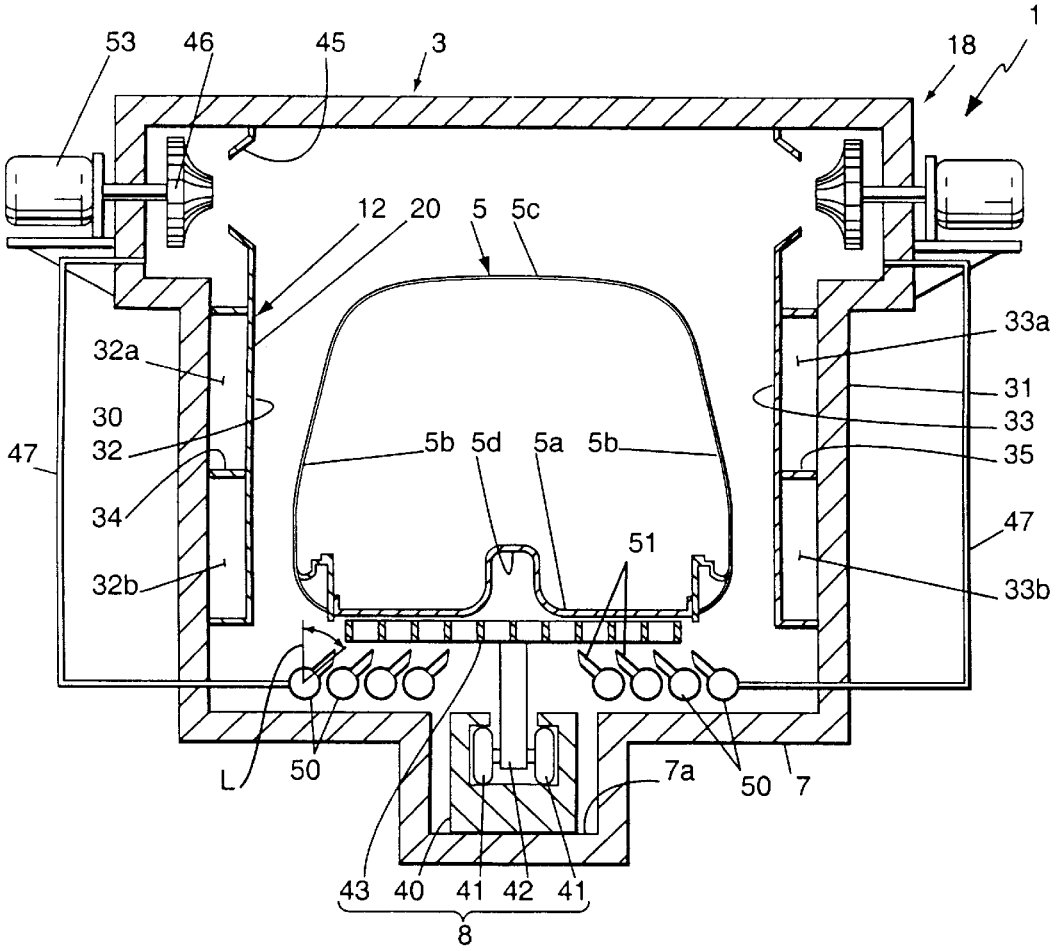
FIG. 2 is a section through line 2—2 in FIG. 1.

FIG. 2 is a sectional view taken through line 2—2 in FIG. 1, and is a section of the second radiant panel curing section 12. Radiant zone 20 in the second radiant panel curing section 12, comprises a main oven unit 3 with left and right side walls 30 and 31, that have U-shaped radiant panels 32 and 33. Partitions 34 and 35 are located in the center of the radiant panels 32 and 33, respectively. The heated air is circulated in upper circulation area 32*a* and 33*a*, and in lower circulation area 32*b* and 33*b*.

The vehicle body 5 comprises a floor 5*a* that is comparatively a heavier steel than the sides 5*b* and roof 5*c*. Floor 5*a* has a recess 5*d* for a drive shaft (not shown).

The conveyor 8 comprises a rail installed in the groove 7*a* of the floor 7, the rail having movable rollers 41 and a support 42. Conveyor frame 43 is positioned on top of support 42, and is used to transport the vehicle 5 in the oven 1. The conveyor frame 43 carries the vehicle 5 and therefore it is desirable to have a grill or net frame for conveyor frame 43 so that the hot air can easily pass therethrough.

Convection section 18 comprises a suction opening 45 positioned at the top of the left and right side partitions 30 and 31. Suction fan 46 is positioned in suction opening 45. Heated air drawn by the fan 46 flows through feed duct 47 into feed pipe 50 which is attached to the feed duct 47, and then through nozzles 51 in the feed pipe 50. Thus hot air blown upwards by the jet nozzles cures the under floor of the body 5 directly. Motor 53 operates the suction fan 46.

Figure 3:
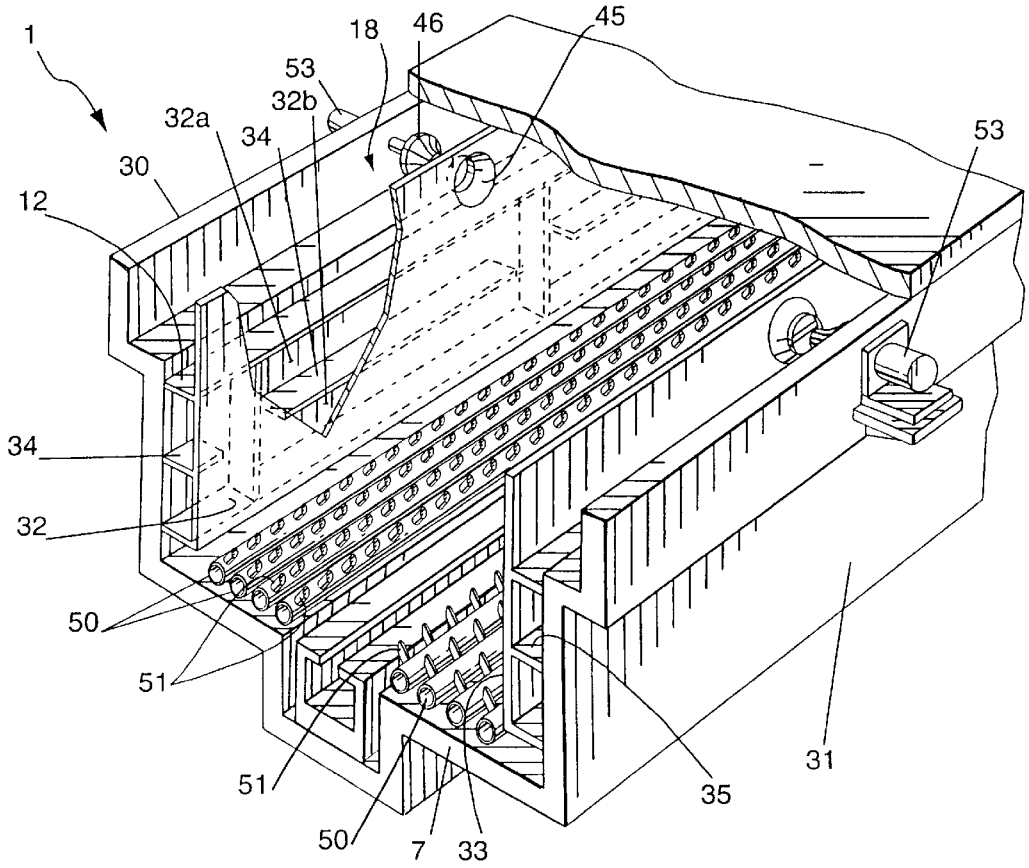
FIG. 3 is a partial perspective sectional view of a first embodiment of a drying oven of the present invention.

FIG. 3 is a perspective sectional view of the curing oven of the first embodiment of the present invention. As can be seen in FIG. 3, the second radiant panel curing section 12 has left and right radiant panels 32 and 33 positioned on the left and right side walls 30 and 31 respectively of the oven 1. Left and right radiant panels 32 and 33 are divided by partitions 34 and 35 to form upper circulation area 32*a*, 33*a* and lower circulation area 32*b*, 33*b*. Further, the suction opening 45 for the convection section 18 is installed in the upper left and right side walls 30 and 31, with the fan 46 located in suction opening 45. The nozzle 51 is positioned in the feed pipe 50 on floor 7.

As can be seen in FIG. 2, the nozzles 51 are small pipes set at a predetermined angle δ to the vertical line L. Inclining the nozzle at the predetermined angle prevents dirt and other debris from falling into the nozzles 51.

The operation of the present invention is explained with reference to FIGS. 4*a* and 4*b* and FIG. 5.

Figure 4A:
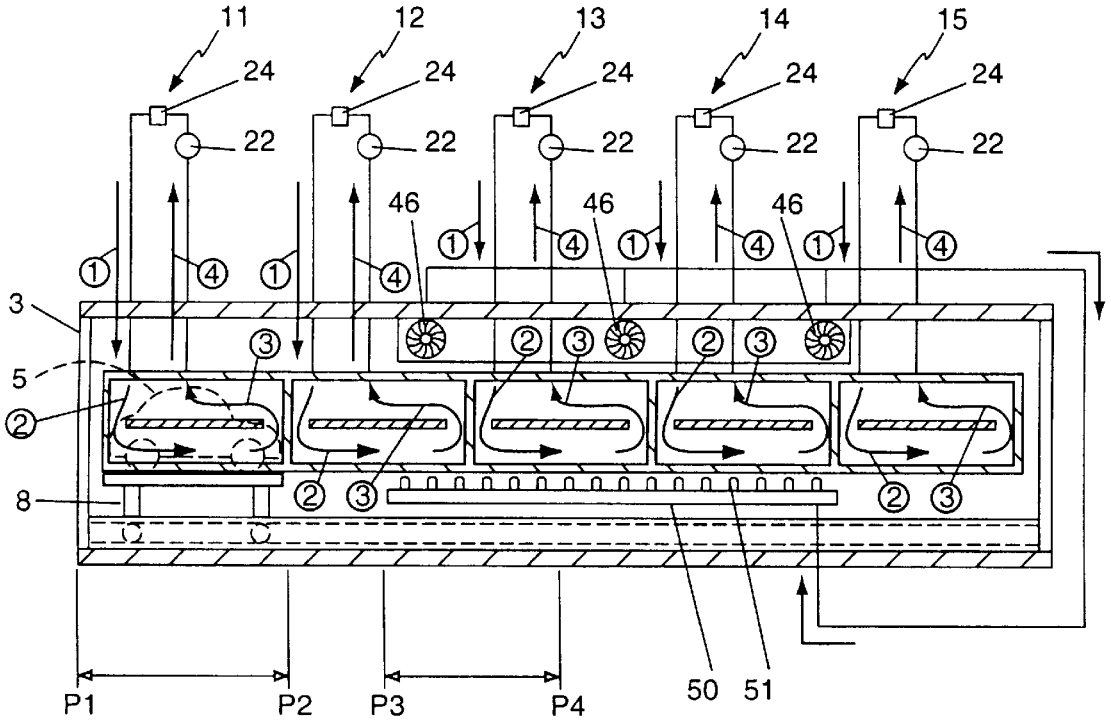
FIGS. 4*a*, 4*b* and 5 are views for explaining the operation of the present invention.
Figure 4B:
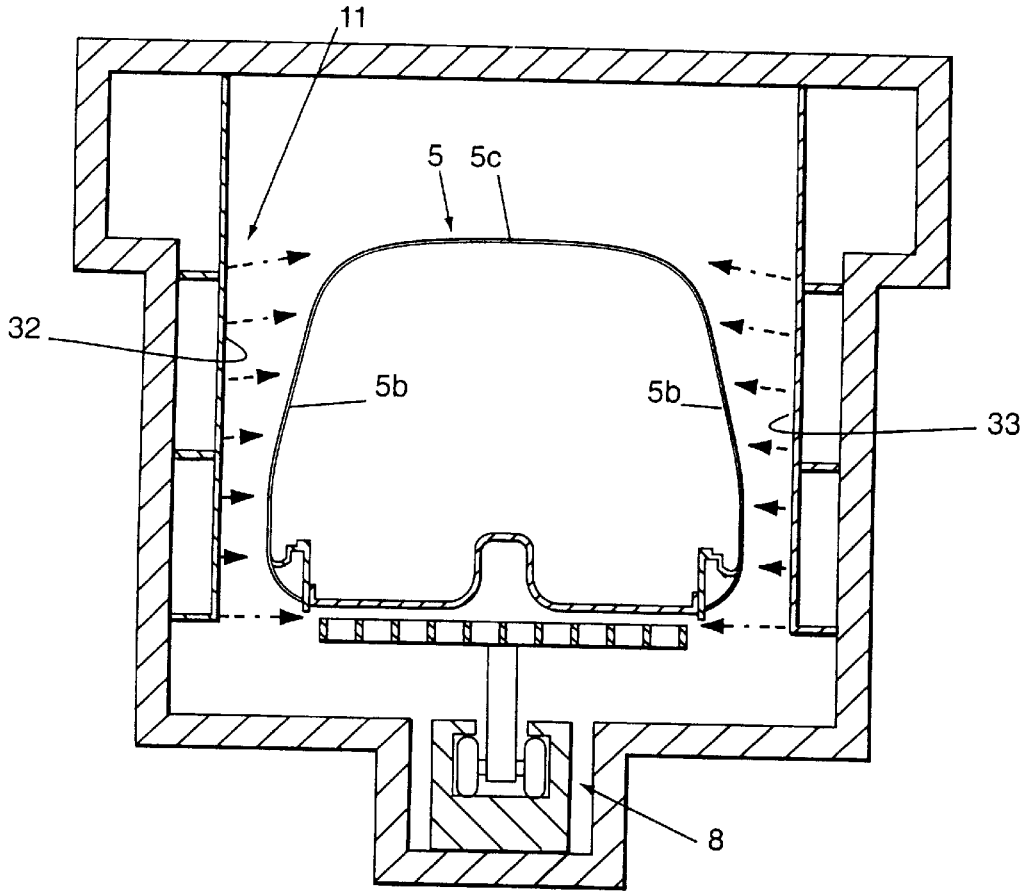

Referring to FIGS. 4*a* and 4*b*, the arrows show the circulation of heated air in the first to fifth radiant panel curing sections 11–15, when the heater 24 and circulation fan 22 are operating. Simultaneously with the convection section 18, the operation of the suction fan 46 results in the heated air of the oven flowing from feed duct 47 to feed pipe 50 and then being blown out through the nozzles 51.

The vehicle body 5 is transported by the conveyor 8 in the oven unit through the first preheat zone from P1–P2. The movement of heat generated by the radiant panels 32 and 33 to cure the sides 5*b* and the roof 5*c* of the vehicle body 5, is shown in FIG. 4*b*.

Figure 5:
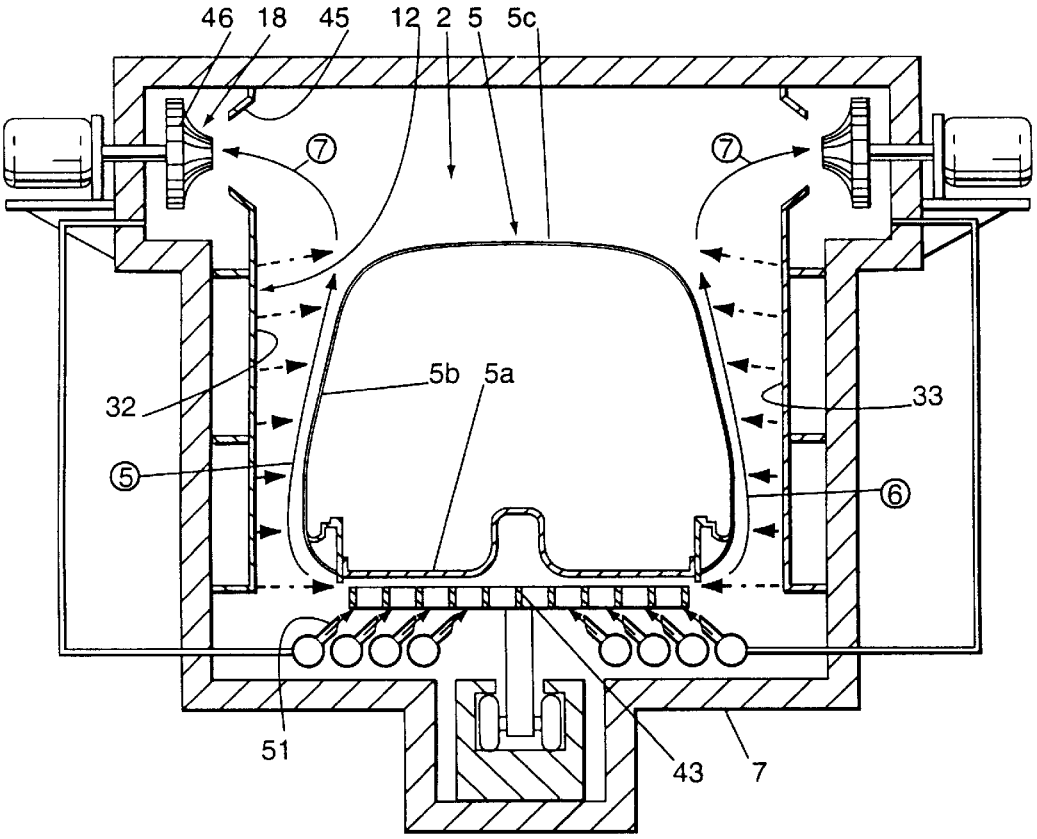

Referring to FIG. 5, the vehicle 5 is located in the heat-up zone between P3 and P4. The left and right radiant panels 32 and 33 generate heat in the second radiant panel curing section 12, to cure the paint of the vehicle body sides 5*b* and roof 5*c*. Simultaneously with the convection of the hot air in the curing section, hot air is blown at a high velocity through nozzles 51, as shown by the arrows, to directly bake the floor 5*a* of the vehicle with the heat from the heat jet. The heat jet has a larger coefficient of heat transfer and therefore it is possible to increase the heat capacity. Further in convection section 18, the heated air of baking area 2 is drawn by the suction opening 45, and suction fan 46 as shown by the arrows 6 and 7.

By means of mounting the nozzles 51 on the floor 7, and constructing the conveyor frame using a grill shape, the hot air is blown onto the floor area 5*a* including the recess 5*d* of the vehicle 5. Therefore, the heat-up time of the floor 5*a* is reduced.

Figure 8:
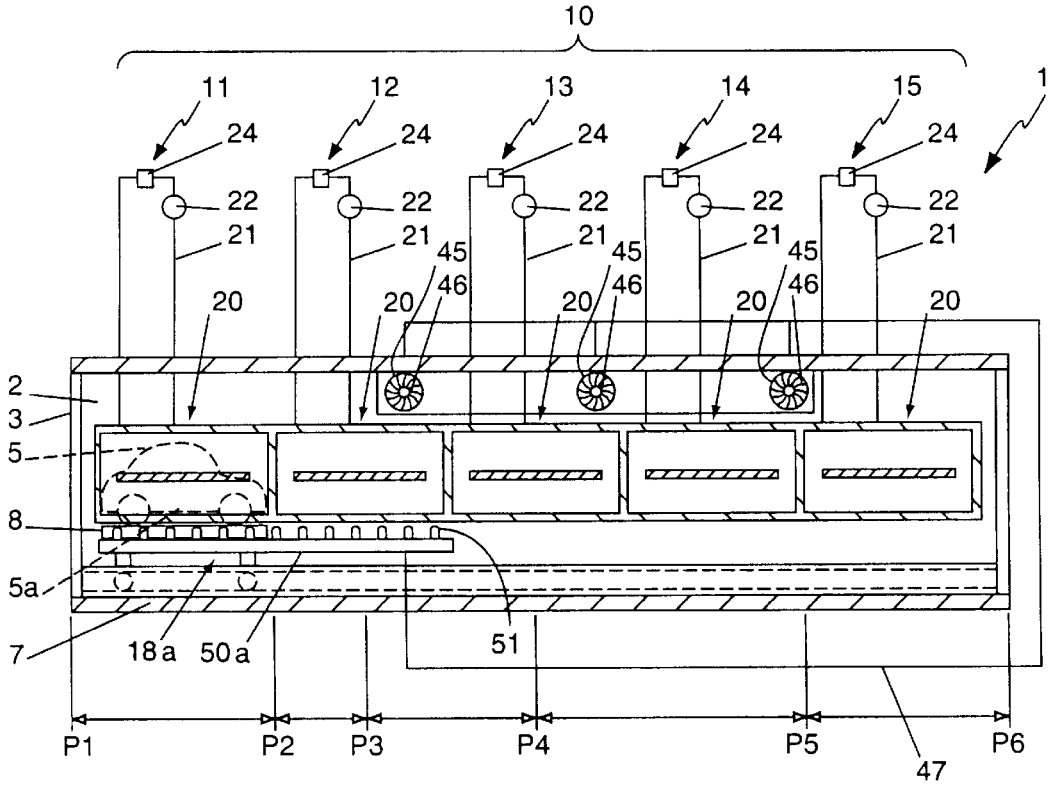
FIG. 8 is a sectional view of an alternative arrangement of the vehicle drying oven of the first embodiment of the present invention.
Figure 9:
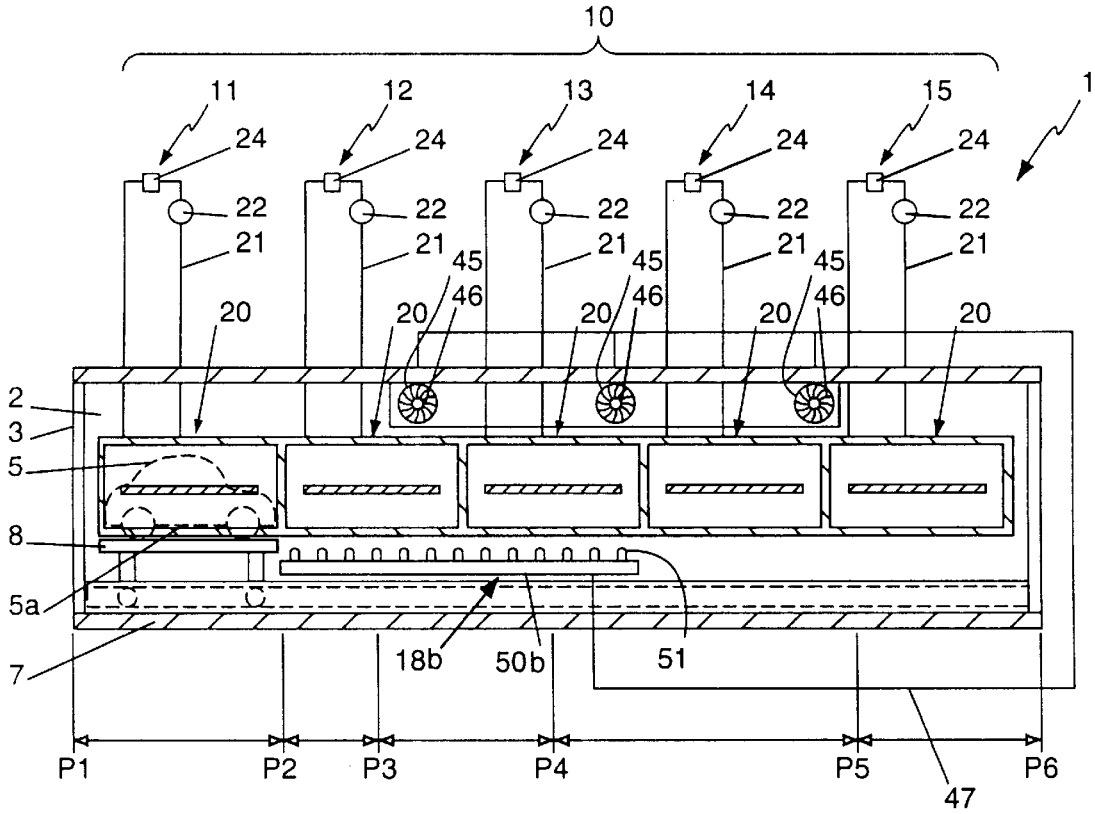
FIG. 9 is a sectional view of another alternative arrangement of a vehicle drying oven of the first embodiment of the present invention.

FIGS. 8 and 9 are alternative embodiments of the first embodiment of the present invention. In the embodiment shown in FIG. 8, the convection section 18*a*, which includes the feed pipe 50*a*, is located in the first preheat zone between points P1 and P2, the second preheat zone between points P2 and P3 and extends into the heat-up zone between points P3 and P4. In another alternative embodiment shown in FIG. 9, the convection section 18*b*, including feed pipe 50*b*, is located in the second preheat zone between points P2 and P3, in the heat-up zone between points P3 and P4, and in the keep zone between points P4 and P5. In both of these alternatives, suction fans 46 in suction openings 45 can be provided in the first and second preheat zones as well. The positioning of the convection section 18, 18*a* or 18*b*, depends upon the particular vehicle and curing requirements.

Figure 6A:
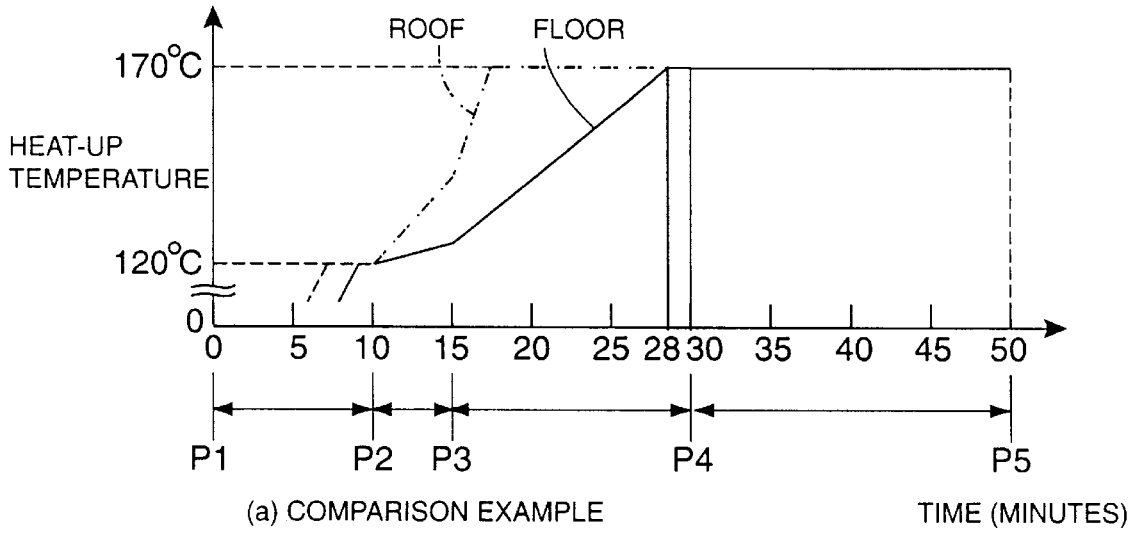
FIGS. 6*a* and 6*b* are graphs showing the heating up of the drying oven of the present invention.
Figure 6B:
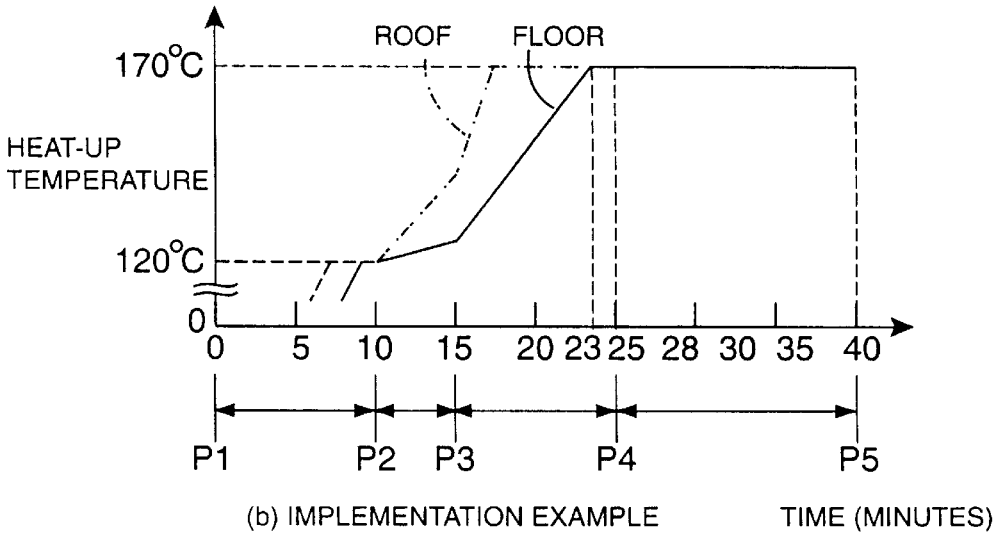

FIGS. 6*a* and 6*b* are graphs showing a comparison of the heating up of the oven of the present invention in comparison to the heating up of the oven in the prior art. FIG. 6*a* shows the temperature in the various heating zones in a prior art oven, and FIG. 6*b* shows the temperature in the various heating zones in the oven of the present invention. In FIGS. 6*a* and 6*b*, the dotted line shows the heating up of the roof of the vehicle and the solid line shows the heating up of the floor of the vehicle.

FIG. 6*a* shows that the hot air velocity in the heat-up zone P3–P4 is low, therefore the floor requires 13 minutes to heat-up to a temperature of 170° C. Further in the keep zone, P4–P5, 20 minutes are required for curing. In the heat-up zone between P3–P4, the roof reaches the temperature of a 170° C. in a shorter period, therefore the difference in time required to raise the temperature of the roof and the floor is large, and thus it is difficult to balance paint curing.

Referring to FIG. 6*b*, the floor heat-up time is reduced to 8 minutes by blowing high velocity, hot air on the floor area in the heat-up zone P3–P4. Further, the time in the keep zone P4–P5 is also reduced to 15 minutes. The heat-up zone is thus reduced by 5 minutes and the keep zone is reduced by 5 minutes so that the overall curing time can be reduced by 10 minutes, resulting in the shortening of the oven. Furthermore, reducing the difference in time required to raise the temperature of the roof and the floor, makes it easier to properly balance the curing of the roof and the floor.

Figure 7:
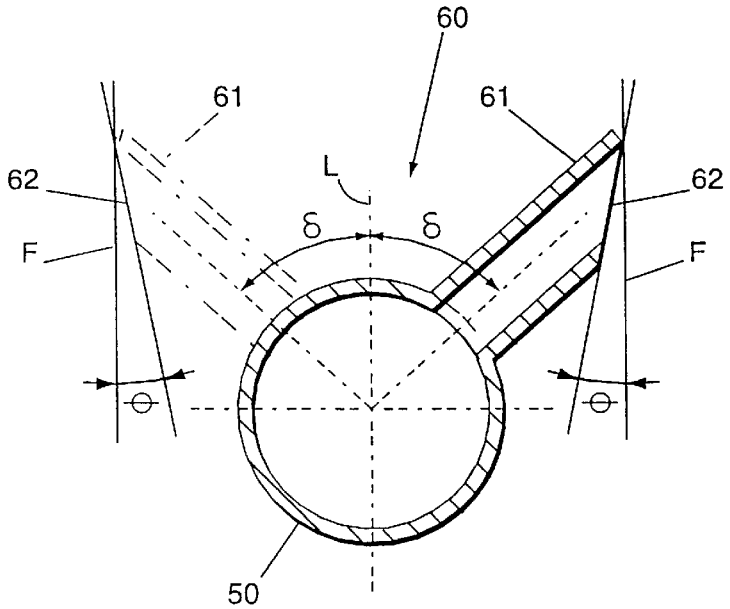
FIG. 7 is a sectional view of a nozzle used in the oven of the first embodiment of the present invention.
Figure 10:
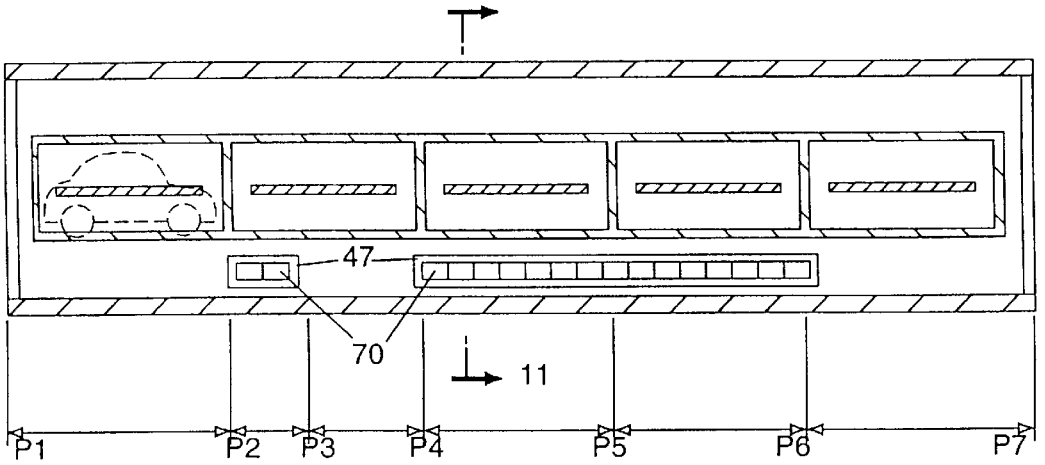
FIG. 10 is a sectional view of a vehicle drying oven of a second embodiment of the present invention.

FIG. 7 is a sectional view of the nozzles in the convection curing section 60. The nozzle 61 has a tip cut 62 which is at an angle to prevent the falling of dust, dirt, etc. from getting into the nozzle 61. The cut 62 is at an angle θ with respect to the vertical axis F. Nozzles 61 extend from both the left and right sides of feed pipe 50 at an angle δ with respect to the vertical.

In the present invention, the feed pipe 50 and nozzles 61 installed on the floor of the curing oven, ensure that hot air is blown over the entire floor area of the vehicle body. This not only enables the under floor of the vehicle body to be baked efficiently, but also helps to reduce the time required for curing. As a result, the curing time required for the vehicle body is reduced which reduces equipment costs as well as energy costs. Orienting the nozzles 61 at an angle and having a tip with a surface angled in the opposite direction, prevents dirt, dust and other foreign objects from falling into the nozzles which could result in blockage of the nozzles.

Figure 11:
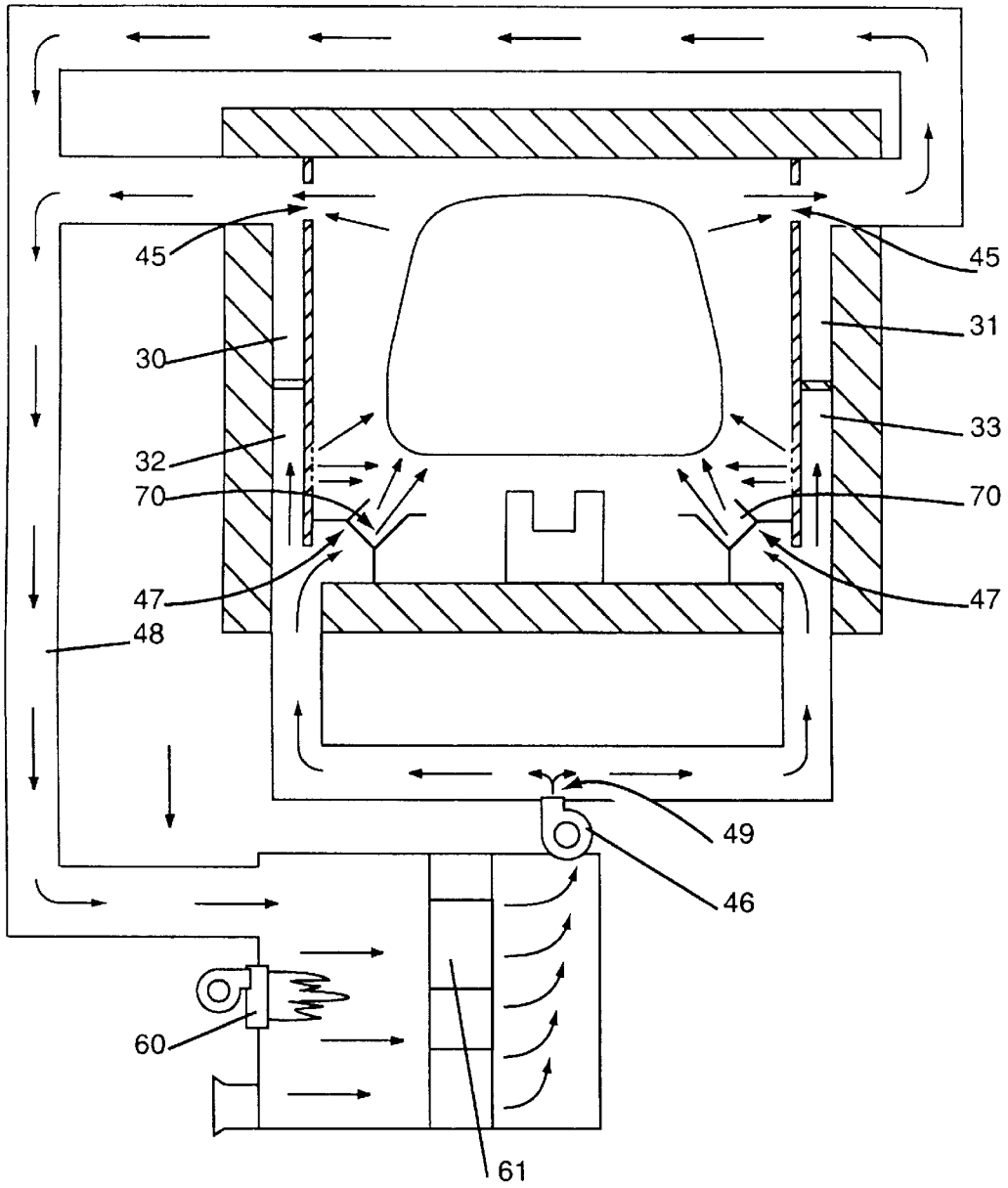
FIG. 11 is a sectional view through lines 11—11 in FIG. 10.

In the second embodiment of the present invention shown in FIGS. 10–12*b*, the feed pipe of the first embodiment is replaced with a feed duct 47 and a plurality of side mounted hot air nozzles 70 which are positioned within the oven starting in the heat-up zone 1, between points P2 and P3. The feed duct 47 and the side mounted hot air nozzles 70 commence again at the start of the keep zone 2, and end midway of the keep zone 3 between points P4 and P6. In the embodiment shown in FIG. 10, the blow ducts do not extend the entire length of the oven. However the blow ducts can be located at any point within the oven. In this second embodiment, as seen in FIG. 11, the convection flow consists of a heated air return section opening 45 at the top of left and right of partitions 30 and 31. Heated air is drawn from opening 45 by fan 46 and flows through return duct 48. The heated air then passes through a burner box which is comprised of a combustion blower/burner 60, and a filter section 61. Once the heated air is reheated, it passes through a filter and then fan 46 supplies the reheated supply air through duct 49 and feed duct 47. The hot air is blown upwards through the side mounted hot air nozzles 70, directly onto the floor of the body.

Figure 12A:
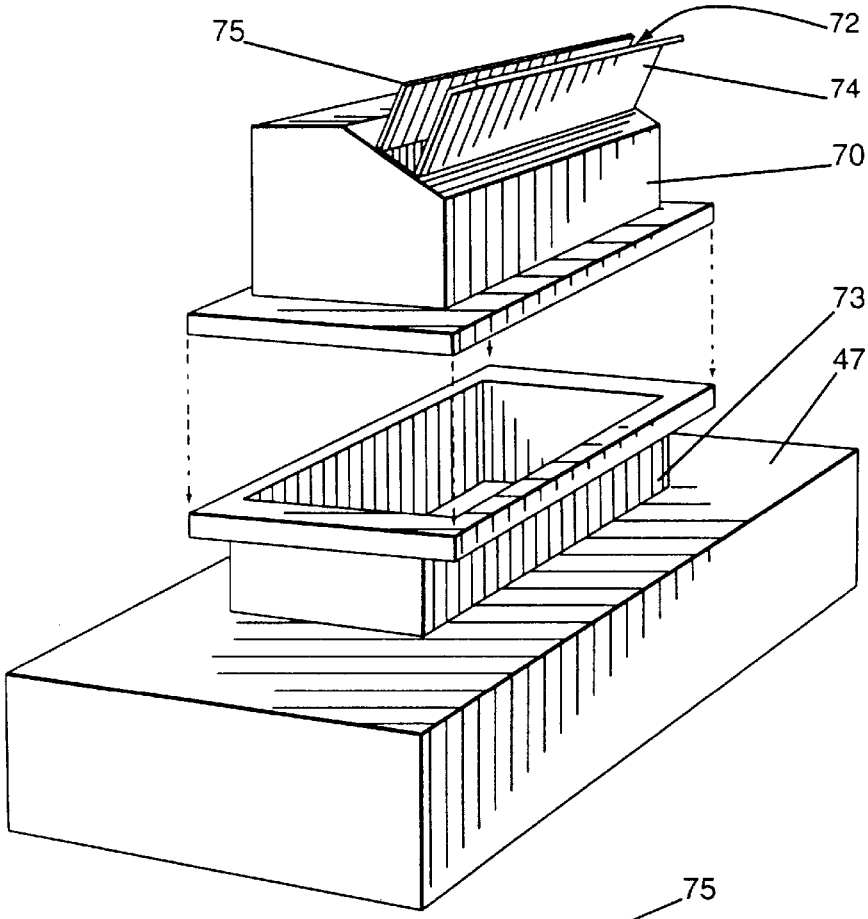
FIG. 12*a* is an exploded perspective view of a side mounted heating vent of the second embodiment of the present invention.
Figure 12B:
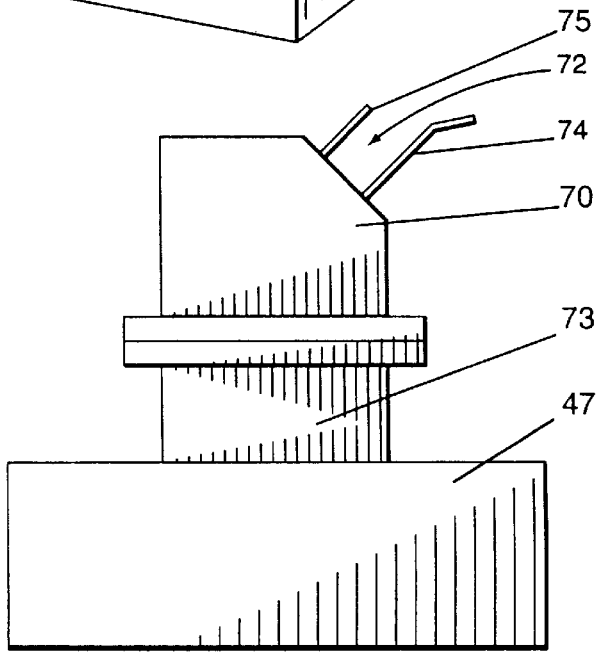
FIG. 12*b* is an exploded side view thereof.

FIGS. 12*a* and 12*b* show the structure of each hot air nozzle. Feed duct 47 contains flanged takeoffs 73 located on the feed duct and the hot air nozzle 70 mounts to the flanged take off 73. Hot air nozzle 70 has two vanes 74 and 75 which control the hot air velocity and direction. Hot air flows out of opening 72 towards the under floor of the vehicle body.

The vanes are manually adjusted and locked in place by means of a piano style hinge (not shown) and locked in place with a slotted hole and wing nut set up (not shown). Two vanes are required for proper angular adjustment and as the vanes are moved together, hot air velocity increases. The vanes can also be automatically adjusted and can be very precisely directed to specific areas.

All of the hot air nozzles 70 are connected to the feed duct 47 which provides hot air. Feed duct 47 is connected to all of the hot air units within its own zone. Heat-up zone 1 keep zone 2 and keep zone 3, all have separate feed ducts. The connection is in series. Feed duct 47 is located within the oven between the lower side wall and oven floor.

The second embodiment of the present invention provides adjustability for directing the hot air to a target area; and adjustability in opening size to vary velocity. Maintenance is friendly; access within the oven is not restricted as with pipes and nozzles on the floor; and nozzle maintenance can be performed simply by unbolting the flanges and removing them for cleaning or repairs. Further, efficiency operation is increased thereby reducing energy costs. The floor of the vehicle is baked to the proper temperature thereby eliminating the need to use wax as a rust inhibitor, and the heater units can be effectively used for production of any model or model mix.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

We claim:

1. A drying oven for curing paint applied to a vehicle, said drying oven comprising:

(a) a housing, said housing having a top surface, side walls, a floor, an opening at a forward end of said housing, and an opening at a rear end of said housing;

(b) radiant heat panels located on the side walls of said housing;

(c) a conveyor to carry the vehicle through the housing; and (d) a convection heater unit having a plurality of nozzles, wherein at least one of the nozzles is positioned directly beneath said vehicle such that heat emitted from said convection heater is directed directly onto an under floor of the vehicle carried through said housing by said conveyor.

2. A drying oven as set forth in claim 1, wherein said drying oven includes at least two heating zones wherein said two zones are a preheat zone, a heat-up zone and wherein the maximum temperature in said two zones is different.

3. A drying oven as set forth in claim 1, wherein said convection heater unit further comprises a feed pipe positioned below the vehicle wherein said plurality of nozzles extend from said feed pipe.

4. A drying oven as set forth in claim 3, wherein an axis of said nozzles extending from said feed pipe is at an angle with respect to a vertical line of said feed pipe.

5. A drying as set forth in claim 4, wherein a surface of a tip of said nozzles is at an angle with respect to the vertical line of said feed pipe.

6. A drying oven as set forth in claim 3, further including a feed duct for carrying hot air to said feed pipe.

7. A drying oven as set forth in claim 6, wherein said feed duct extends from an upper portion of said housing to said feed pipe, and wherein said feed pipe provides hot air from the upper portion of said housing to said feed pipe.

8. A drying oven as set forth in claim 7, including a fan positioned in said feed duct for drawing hot air from said housing and feeding the air through said feed duct, said feed pipe and said nozzles.

9. A drying oven as set forth in claim 3, wherein said at least two heating zones is three heating zones including a keep zone and said preheat zone and said heat-up zone.

10. A drying oven as set forth in claim 9, wherein said feed pipe is located in said heat-up zone and said keep zone.

11. A drying oven as set forth in claim 9, wherein said feed pipe is located in said preheat zone and said heat-up zone.

12. A drying oven as set forth in claim 9, wherein said preheat zone includes a first preheat zone and a second preheat zone and wherein said feed pipe is located in said second preheat zone, said heat-up zone, and said keep zone.

13. A drying oven as set forth in claim 1, wherein said conveyor has a grill shape and carries the vehicle through said housing such that the heat emitted from said plurality of nozzles of said convection heater is directed through said grill shaped conveyor directly onto the under floor of the vehicle passing through said housing on said conveyor.

14. A drying oven as set forth in claim 13, wherein said convection heater unit is positioned directly beneath said conveyor.

* * * * *